US005735779A

United States Patent [19]

Lay

[11] Patent Number: 5,735,779

[45] Date of Patent: Apr. 7, 1998

[54] ROTARY EXERCISER

[75] Inventor: Sen-Chyi Lay, Taipei, Taiwan

[73] Assignee: Pro-Supra International Corp., Taipei, Taiwan

[21] Appl. No.: 850,519

[22] Filed: May 2, 1997

[51] Int. Cl.[6] ..... A63B 21/075

[52] U.S. Cl. ..... 482/93

[58] Field of Search ..... 482/93, 106–109

[56] References Cited

U.S. PATENT DOCUMENTS 5,407,405 4/1995 Oren ..... 482/106 X

FOREIGN PATENT DOCUMENTS 2001650 10/1993 Russian Federation ..... 482/107

*Primary Examiner*—Richard J. Apley
*Assistant Examiner*—John Mulcahy
*Attorney, Agent, or Firm*—David E. Dougherty

[57] ABSTRACT

A rotary exerciser including a frame assembly having an upper and a lower sleeves and a polished stem connected to middle sections of the sleeves to form an I-shaped pattern. Each sleeve is formed with two axial slots on two sides. Two locating sleeves are fitted around the stem and locked by locating screws. The exerciser further includes left and right M-shaped members each of which is composed of first and second opposite solid members each having a 90 degrees bight section. An end of the solid member is formed with radial thread hole and inserted into the upper and lower sleeve and adjustably locked in the axial slot thereof. The bight sections of the solid members are connected by an inward arched tube to define an open portion. Two ring-like grips are rotatably disposed in the open portions. Several weights are fitted around the stem, whereby a user can grip the handles of the grips with both hands to push forward, lift, obliquely push and revolve the exerciser. In addition, the user can rotate the grips in cooperation with the horizontal and vertical movement to train his muscle.

1 Claim, 7 Drawing Sheets

ROTARY EXERCISER

BACKGROUND OF THE INVENTION

The present invention relates to a rotary exerciser. A user can grip the grips of the exerciser with both hands to forward push, lift, obliquely push and revolve the exerciser. In addition, the user can rotate the grips in cooperation with the horizontal and vertical movement to achieve a versatile exercising effect.

Many types of exercisers are commercially available, such as rowing devices, steppers, weight trainers, etc. Such devices are operated by a single attitude or at most two or three attitudes without change. Therefore, it is impossible to create fresh feeling and achieve entertaining effect.

SUMMARY OF THE INVENTION

It is therefore a primary object of the present invention to provide a rotary exerciser. A user can grip the grips of the exerciser with both hands to freely push forward, lift, obliquely push and revolve the exerciser. In addition, the user can rotate the grips in cooperation with the horizontal and vertical movement. Also, as necessary, multiple weights can be easily added to the exerciser to train the muscle of a user. The exerciser has small volume and can be operated without limitation of site and time so as to achieve a versatile exercising effect.

The present invention can be best understood through the following description and accompanying drawings, wherein:

DETAILED DESCRIPTION OF THE PREFERRED EMBODIMENT

Figure 1:
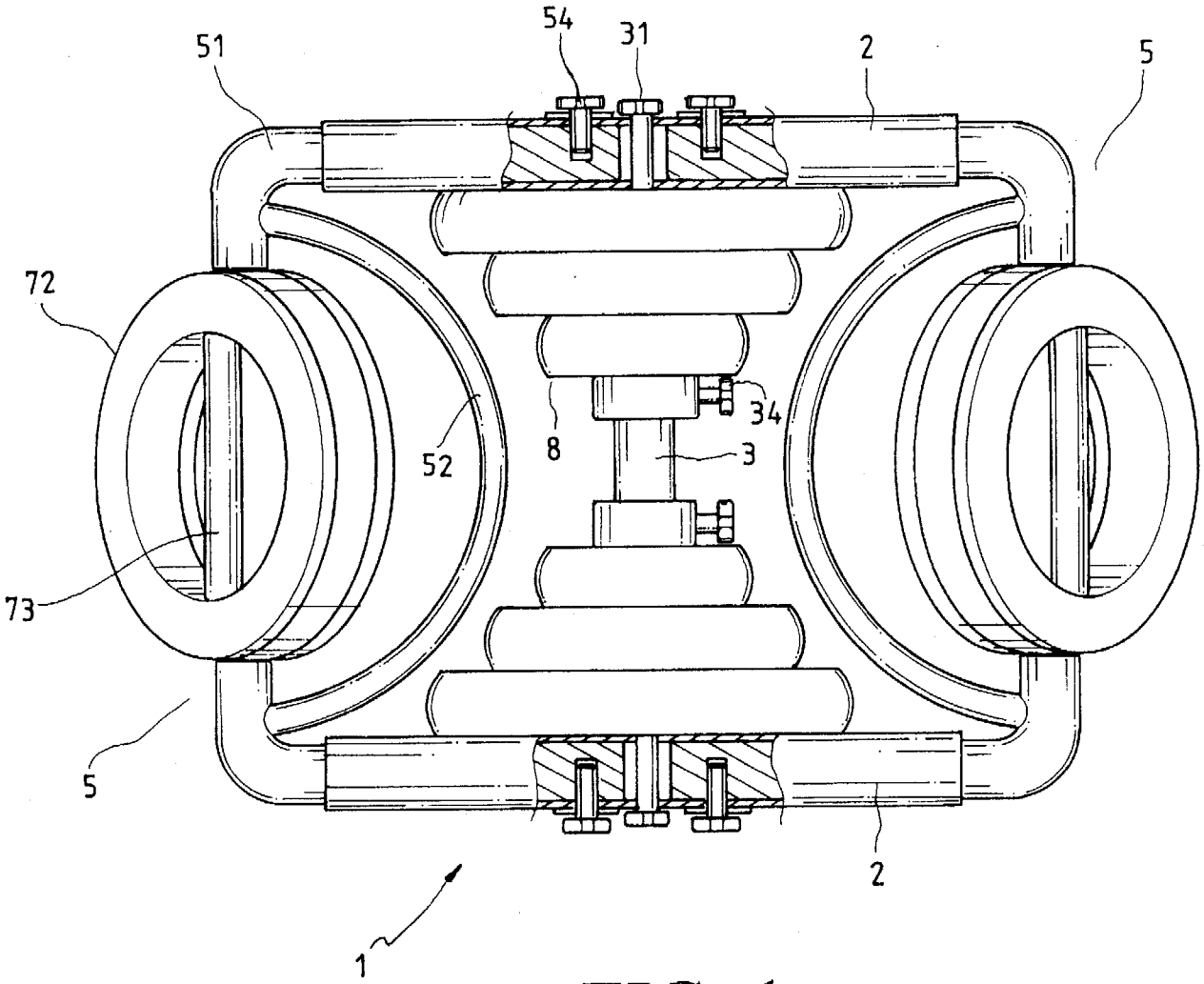
FIG. 1 is a front view of the present invention.
Figure 2:
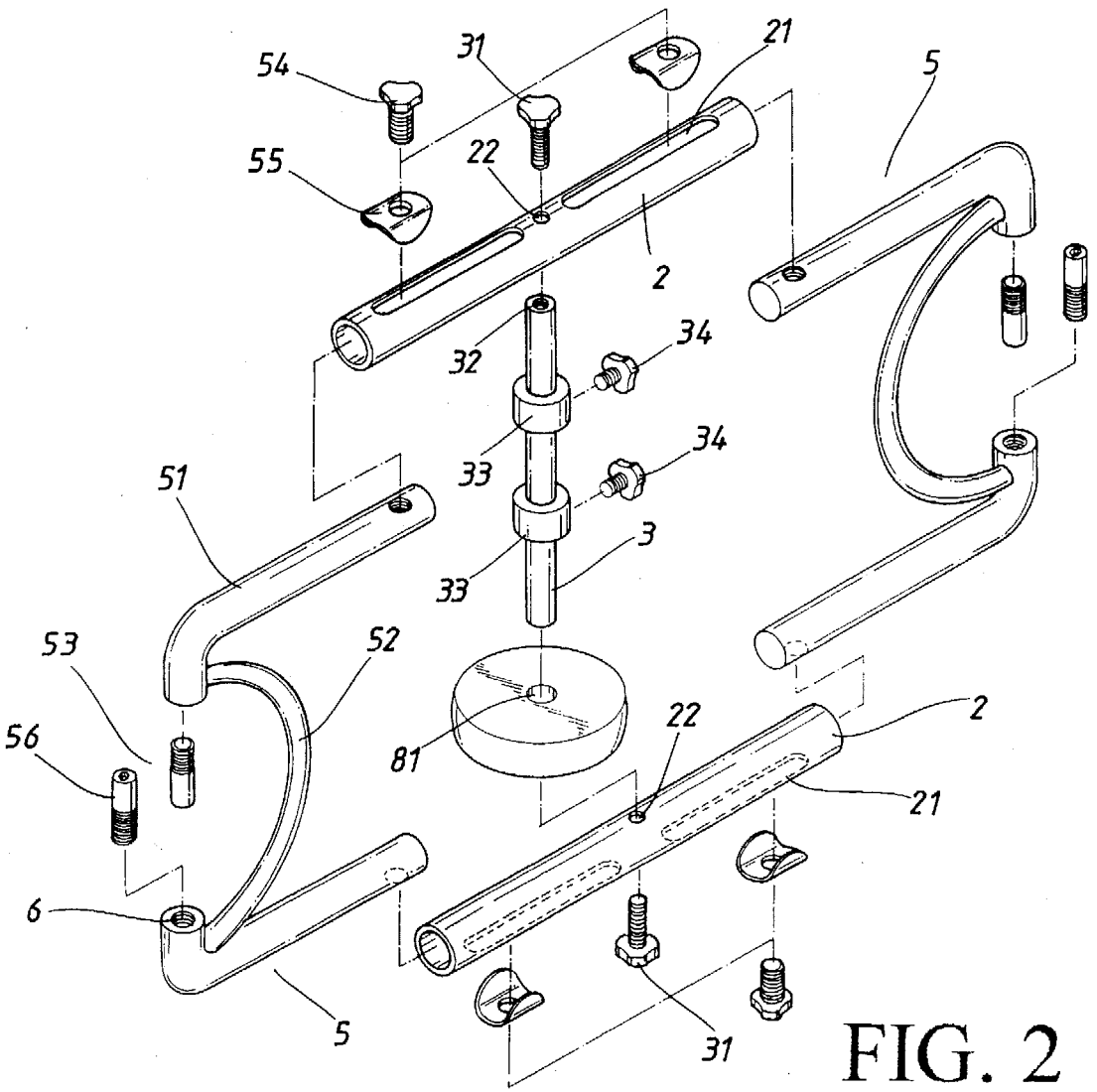
FIG. 2 is a perspective exploded view of the present invention.

Please refer to FIGS. 1 and 2. The present invention includes a frame assembly composed of upper and lower sleeves 2, a polished stem 3, left and right M-shaped members 5, left and right ring-like grips 7 and multiple weights 8.

Each sleeve 2 is formed with two axial slots 21 on two sides and a central through holes 22.

The polished stem 3 is formed with inner thread holes 32 at two ends. Two fastening screws 31 are passed through the through holes 22 and screwed into the thread holes 32 to secure the sleeves 2 on the stem 3. Two locating sleeves 33 are fitted around the stem 3 and locked at a certain position by manually operated locating screws 34.

The M-shaped member 5 is composed of a first and a second opposite solid members 51 each having a 90 degrees bight section. The end of the solid member 51 is formed with radial thread hole and is inserted into the sleeve 2. The bight sections of the solid members are connected by an inward arched tube 52 to define an open portion 53. The end of the bight section is formed with axial thread hole 6, whereby a hexagonal bolt 56 can be screwed therein to secure the grip 7. An arch washer 55 is disposed on outer side of the slot 21 of the sleeve 2 and a fastening screw 54 is passed therethrough and secured in the sleeve 2.

Figure 3:
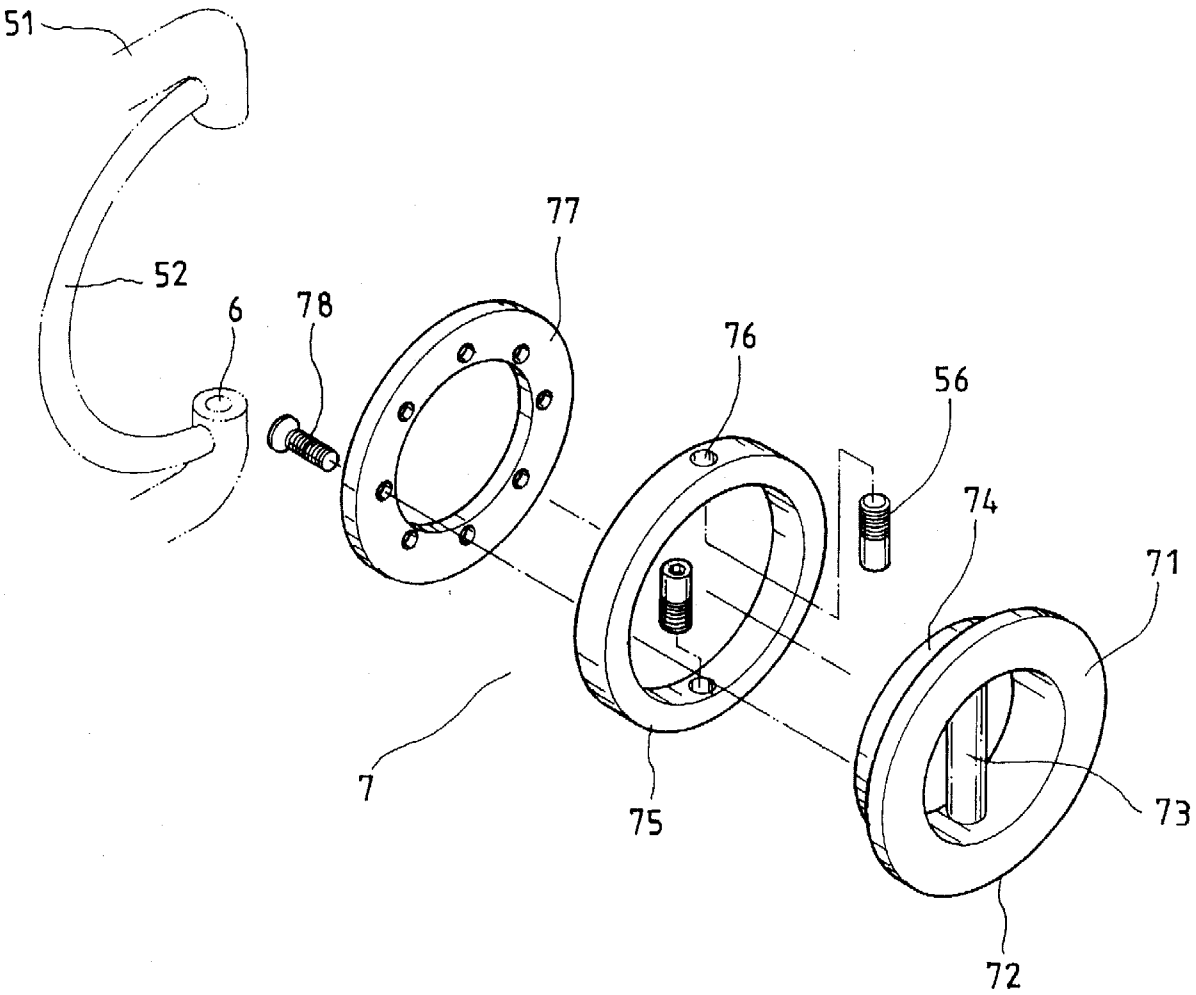
FIG. 3 is a perspective exploded view of the grip of the present invention.
Figure 4:
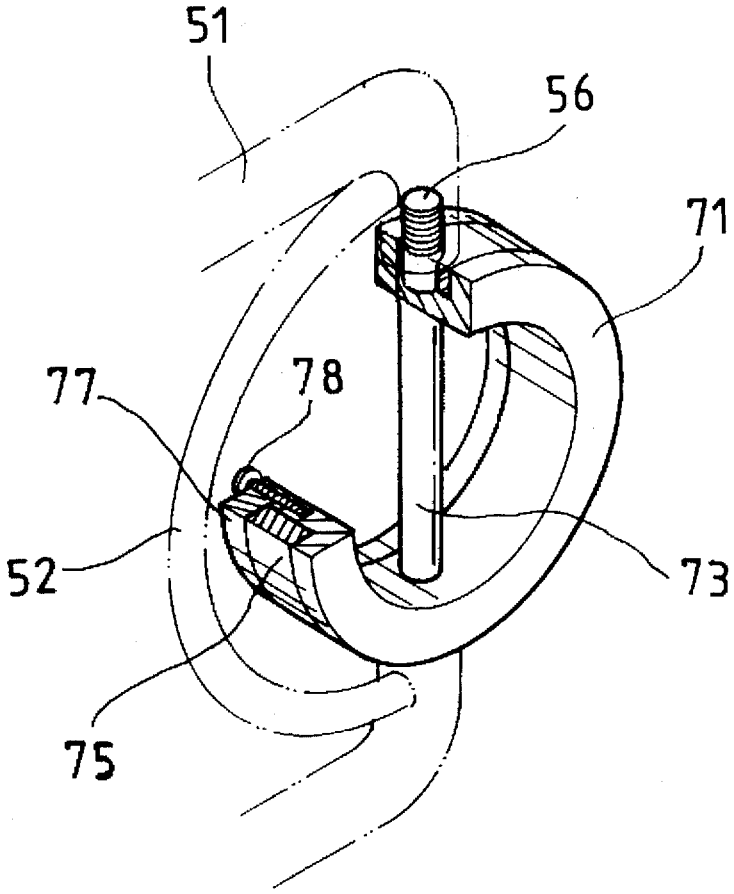
FIG. 4 is a sectional assembled view of the grip of the present invention.

Referring to FIGS. 3 and 4, the ring-like grip 7 includes an outer disk 72 having a flange 71 and a handle 73 disposed therein. One side of the outer disk 72 is formed with a small diameter section 74 having thread holes on lateral side. A ring member 75 is fitted on the small diameter section 74 and a cover board 77 is overlaid on the ring member. Multiple bolts 78 are passed through the through holes of the cover board 77 to assemble the above components into the ring-like grip 7. The top and bottom of the ring member 75 are formed with through holes 76. The hexagonal bolts 56 are passed through the through holes 76 and tightened in the thread holes 6, whereby the grip can be freely rotated.

Each weight 8 is formed with a central hole 81. When it is desired to additionally hang the weight 8 on the exerciser, the fastening screws 31 and 54 are untightened and then the weight 8 is fitted around the stem 3 and then the screws are again tightened to tightly abut against the locating sleeve 33 which is secured by the locating screw 34 without loosening.

After assembly, suitable weights 8 are added to the stem 3 and fastened by the locating sleeves 33. Also, the ring-like grips 7 are rotatably disposed in the open portions 53 of the M-shaped members 5. A user can grip the handles 73 with both hands to forward push, lift, obliquely push and revolve the exerciser. In addition, the user can rotate the grips 7 in cooperation with the horizontal and vertical movement to train his muscle.

Figure 5:
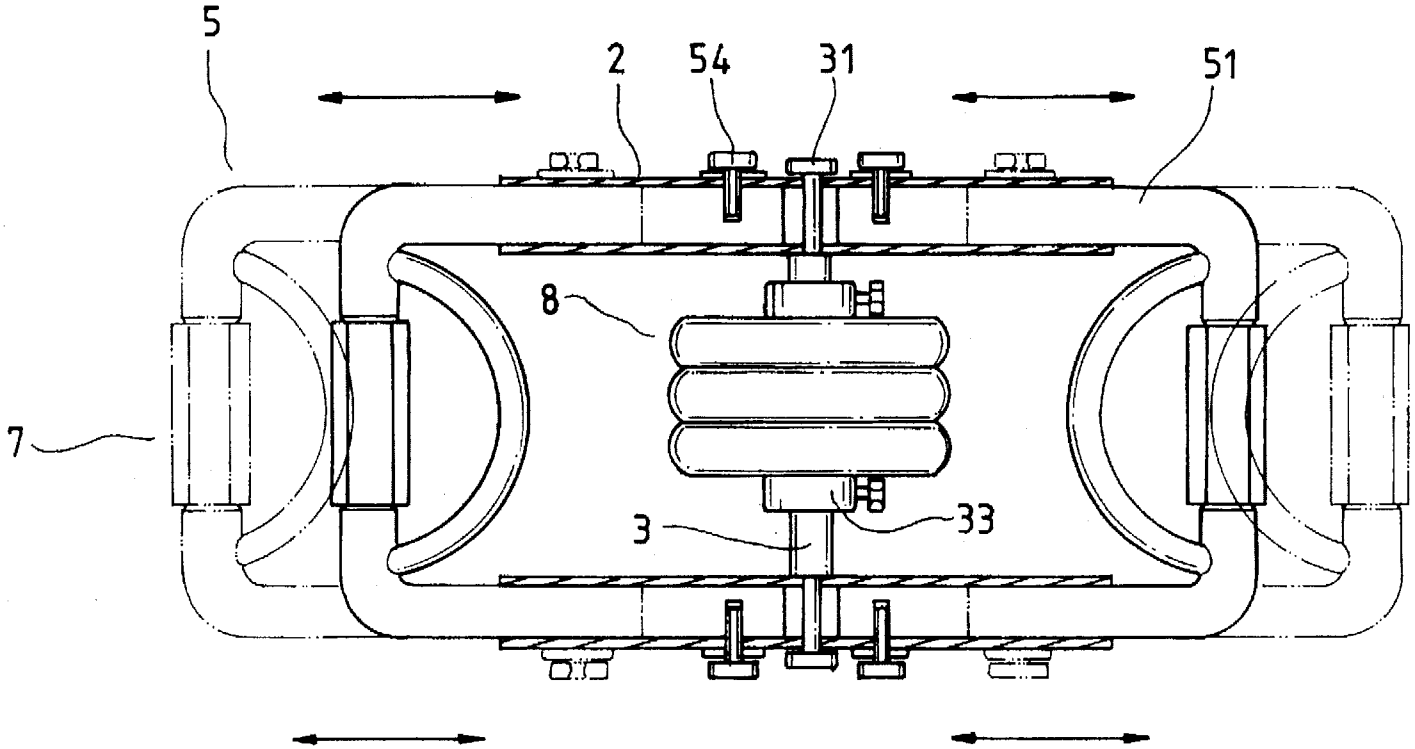
FIG. 5 shows that the exerciser of the present invention may be pulled leftward and rightward.
Figure 7:
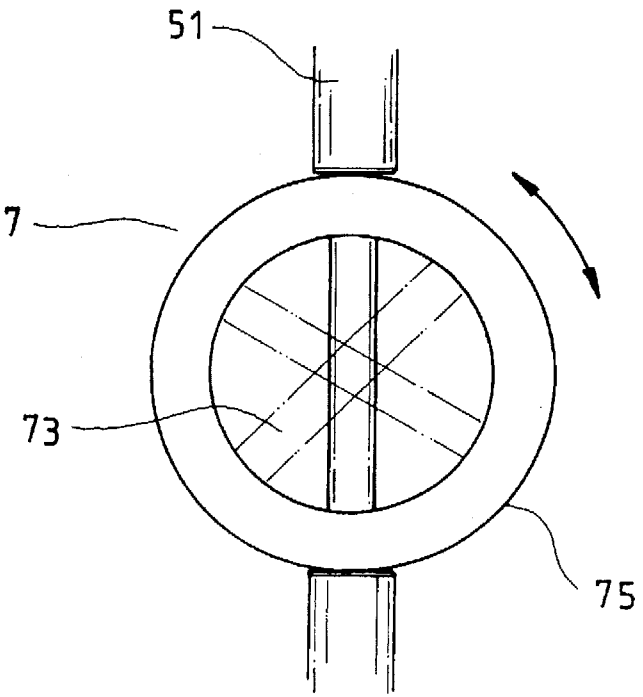
FIG. 7 shows that the grip of the present invention may be revolved.
Figure 6:
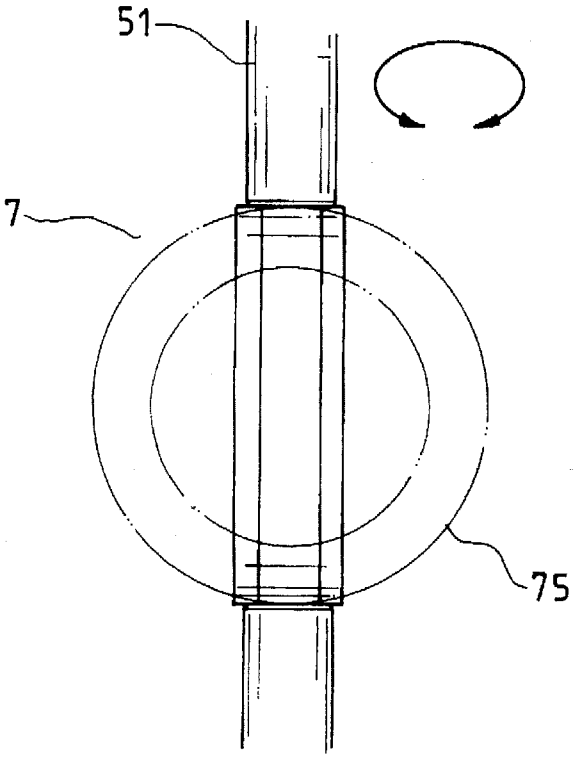
FIG. 6 shows that the grip of the present invention is rotatable.

Referring to FIG. 5, when it is desired to pull the exerciser left or right, the fastening screws 54 are untightened and the M-shaped members 5 are shifted outward according to the width of the shoulders of the user. FIGS. 6 and 7 show that the grip 7 can be rotated 360 degrees about the hexagonal belt 56 or revolved with the ring member 75 serving as a supporting face to exercise the muscle.

Figure 8:
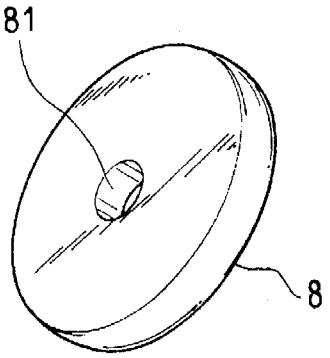
FIG. 8 is a perspective view of the weight of the present invention.

Referring to FIG. 8, the weights 8 can be divided into large, middle and small ones.

Figure 9:
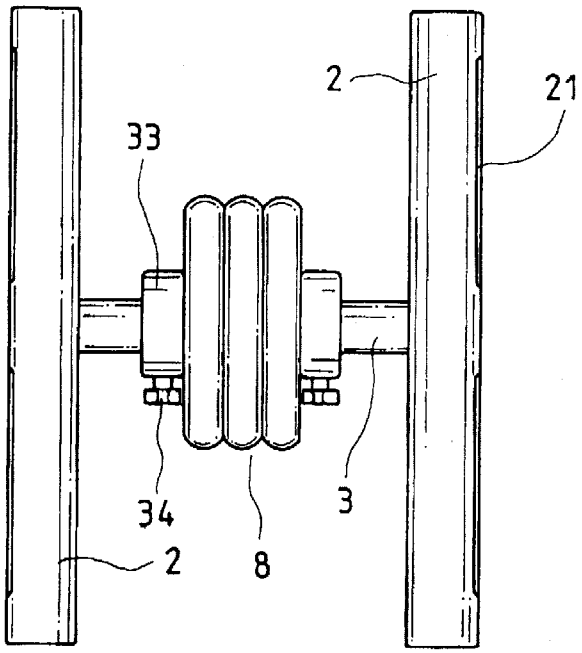
FIG. 9 shows that the weights are positioned at the center of the exerciser of the present invention.
Figure 10:
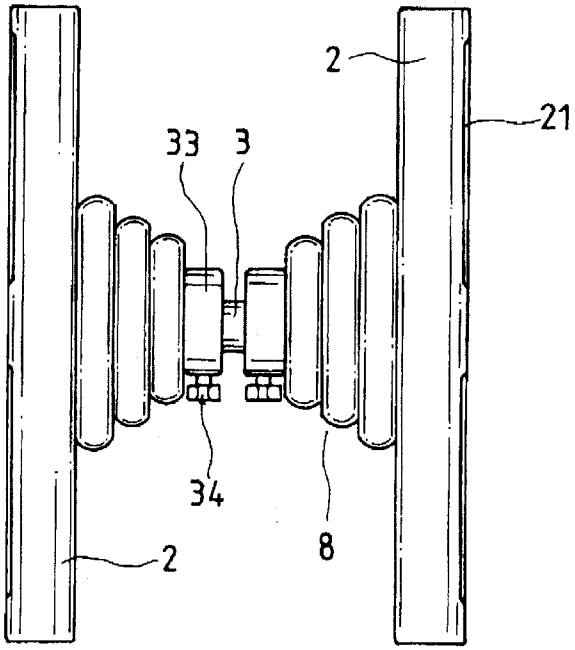
FIG. 10 shows that the weights are positioned on two sides of the exerciser of the present invention.

Referring to FIGS. 9 and 10, when adding the weight 8 to the polished stem 3, the weight 8 is locked at the central section by the locating sleeve 33 via the small screw 34 as shown in FIG. 9 or is locked on two sides as shown in FIG. 10. The number of the weights 8 is determined by the user.

In operation, the left and right M-shaped members 5 are adjusted to a desired width and then the fastening screws 54 are fully tightened to firmly associate the frame assembly 1 with the M-shaped members 5. The user can grip the handles 73 with both hands to push forward lift, obliquely push and revolve the exerciser. In addition, the user can rotate the grips 7 in cooperation with the horizontal and vertical movement to train his muscle. In addition, the user can rotate the grip 7 upward with his right hand and simultaneously rotate the other grip 7 downward with his left hand and then rotate the grip 7 upward with his left hand and simultaneously rotate the other grip downward with his right hand to complete a reciprocal half-rotation movement. Also, a forward right side and forward left side reciprocal half-rotation movement can be performed to achieve a versatile exercising effect.

Alternatively, the left and right M-shaped members can be inwardly retracted and the fastening screws 54 are totally tightened. The user can held the handles 73 of the grips 7 with the palms inclined upward or downward and positioned in front of the chest. Accordingly, the exerciser can be rotated clockwise or counterclockwise. Cooperatively, the grips 7 can be rotated horizontally, vertically or inclinedly.

Also, one M-shaped member can be retracted with the other one pulled outward and then the fastening screws 54 are totally tightened so as to shift the gravity center. In this case, when operated, a different feeling is achieved. Alternatively, the weights 8 can be placed on one side to shift the gravity center so as to achieve a different feeling.

Also, two sets of the above exercisers can be operated by two users standing opposite to each other and holding one end of each exerciser with both hands. Accordingly, the two exercisers can be operated and rotated simultaneously with more fun. However, the two exercisers cannot be moved intersectionally to avoid collision.

It should be noted that the above description and accompanying drawings are only used to illustrate one embodiment of the present invention, not intended to limit the scope thereof. Any modification of the embodiment should fall within the scope of the present invention.

What is claimed is:

1. A rotary exerciser comprising:

a frame assembly including upper and lower sleeves and a polished stem connected to middle sections of the sleeves to form an I-shaped pattern, each sleeve being formed with two axial slots on two sides, two locating sleeves being fitted around the stem and locked by locating screws;

left and a right M-shaped members composed of first and second opposite solid members each having 90 degrees bight section, an end of the solid members being formed with a radial thread hole and inserted into the upper and lower sleeve and adjustably locked in the axial slot thereof, the bight sections of the solid members being connected by an inward arched tube to define an open portion, an end of the bight section being formed with an axial thread hole, whereby a hexagonal bolt can be screwed therein to secure the grip;

two ring-like grips each including an outer disk having a flange and a handle disposed therein, one side of the outer disk being formed with a small diameter section having thread holes on a lateral side, a ring member being fitted on the small diameter section and a cover board being overlaid on the ring member, multiple bolts being passed through through holes in the cover board to assemble the above components into the ring-like grip, the top and bottom of the ring member being formed with through holes, the hexagonal bolts being passed through the through holes and tightened in the thread holes of the bight sections; and a weight formed with a central hole, whereby when fitting the weight on the stem, the weight tightly abuts against the locating sleeve which is secured by the locating screw on the stem.

* * * * *